United States Patent [19]

Wilbert

[11] 4,155,457

[45] May 22, 1979

[54] ANTI-PILFERAGE DISPLAY CASE

[75] Inventor: Stephen Wilbert, Cranston, R.I.

[73] Assignee: DiOrio Enterprises, Inc., Providence, R.I.

[21] Appl. No.: 832,427

[22] Filed: Sep. 12, 1977

[51] Int. Cl.[2] ..... A47F 7/02

[52] U.S. Cl. ..... 211/4; 211/13; 340/568

[58] Field of Search ..... 211/163, 4, 7, 8, 13; 206/566, 486, 806, 495; 340/280

[56] References Cited

U.S. PATENT DOCUMENTS

| | | | |
|---|---|---|---|
| 460,019 | 9/1891 | Kruschke | 340/280 |
| 1,208,007 | 12/1916 | Reynolds | 340/280 |
| 1,546,509 | 7/1925 | Poole | 200/153 LA |
| 1,765,223 | 6/1930 | Ferris | 40/397 |
| 2,626,388 | 1/1953 | Needlman | 340/280 |
| 2,708,747 | 5/1955 | Moon | 340/280 |
| 2,926,862 | 3/1960 | Jacobson | 211/163 X |
| 3,424,313 | 1/1969 | Feibelman | 211/13 |
| 3,583,568 | 6/1971 | Crosslen | 211/8 |
| 3,668,681 | 6/1972 | Kaplan | 340/280 |
| 3,717,258 | 2/1973 | McKinnon | 211/4 X |
| 3,725,893 | 4/1973 | Malta et al. | 340/280 |
| 3,768,662 | 10/1973 | Ritzen | 211/4 |
| 3,805,962 | 4/1974 | Bendiksen | 211/4 |
| 3,972,039 | 7/1976 | Marshall | 340/280 |
| 4,026,417 | 5/1977 | Streim | 211/163 |

*Primary Examiner*—Roy D. Frazier
*Assistant Examiner*—Robert W. Gibson, Jr.
*Attorney, Agent, or Firm*—Salter & Michaelson

[57] ABSTRACT

A device is disclosed for the display of jewelry articles such as earrings and the like, such device including a frame to which parallel overlying article supports are attached. The device further includes a slide having a plurality of flanges adapted in turn to overlie the article supports in such a fashion that when the slide is in a lower position, the space between the adjacent flanges and article supports is such that the articles cannot be removed from the latter. The slide is subsequently movable to a second upper position wherein such space is sufficient for the removal of the articles. An alarm responsive to the slide movement between such lower and upper positions serves to indicate any unauthorized attempt to remove an article.

12 Claims, 4 Drawing Figures

ANTI-PILFERAGE DISPLAY CASE

BACKGROUND OF THE INVENTION

This invention relates to a device suited for displaying a plurality of jewelry articles, such as earrings, mounted on cards and the like. The invention is more particularly directed to a display device having spaced upright members between which a plurality of rods are supported so that such card mounted jewelry articles may be supported therefrom by means of a rearwardly extending generally U-shaped hanger.

Such display cases or racks are generally known and include a plurality of such article supports in tiered form. Although they form a convenient manner for the display of such jewelry articles, it also places such in a position susceptible to theft since the cards on which the articles are mounted can be quite readily removed therefrom without much effort by a potential pilferer or purchaser. This is especially so since displays of this type are often subject to minimal supervision by sales personnel.

Attempts have been made to overcome such problems by the formation of display cases in which the manner by which the articles may be removed therefrom is not immediately obvious to the prospective customer. Such attempts include devices which are substantially complex in operation and accordingly may present operational problems to sales personnel as well. It accordingly would be desirable to provide a device of this general type wherein the articles may be readily viewed by prospective customers, their removal not too difficult from the standpoint of sales personnel, and further having some unobvious alarm means activatable upon any attempted unauthorized removal of the articles supported thereby. Of general interest with regard to devices which utilize alarms in connection with display cases and the like are the following U.S. Pat. No. 460,019 to Kruschke and No. 1,765,225 to Ferris.

The patent to Kruschke shows a display having resilient holders for finger rings and the like wherein the opposite arms of the holders are held in spaced relation when an article is positioned therebetween, but when the article is removed, the arms close together to complete an electrical circuit and sound an alarm. The patent to Ferris is of interest since it relates to a display rack having plates or levers 5 on which the articles being displayed are adapted to be positioned. When an article is removed, the plate or lever 5 is free to move upwardly in order to complete a circuit which in turn activates an alarm. Other patents thought to be of general interest include U.S. Pat. Nos. 1,208,007; 1,546,509; 2,708,747; 3,668,681; 3,725,893; and 3,972,039. The above listing and discussion of previous patents where believed appropriate constitutes applicant's Prior Art Disclosure and in accordance therewith a copy of each of such patents is enclosed with this application.

Notwithstanding the structures disclosed in such patents, there still exists a need for a display case which provides the above indicated attributes but which avoids the above discussed prior art shortcomings. The present invention provides such a display device and includes a frame having a plurality of horizontally extending article supports in spaced generally parallel overlying relation to each other and a slide mounted on such frame and having horizontally extending flange means adapted to overlie each of said article supports so that in a normal closed or lower position of the slide, the space between the article supports and flanges is not adequate for removing the article. However, such space may be easily increased to provide for such removal by upward movement of the slide relative to the frame. In addition, alarm means are provided on the frame which means are automatically activated responsive to upward movement of the slide so that unauthorized movement of the slide from the closed to open position may be immediately signalled.

It is accordingly a principal object of the present invention to provide a device of the above indicated type wherein jewelry articles mounted on cards or the like are supported in a normally secure but removable manner but wherein unauthorized removal automatically activates an alarm.

A further object of the present invention is the provision of a display case of the immediately aforementioned type wherein jewelry articles, such as earrings, are mounted on cards having generally U-shaped rearwardly extending support flanges in turn adapted to be supported from a plurality of rods horizontally extending across a frame, and wherein a plurality of flanges are further adapted to overlie such rods in a manner that normally prevents the cards from being withdrawn therefrom, and wherein the flanges may be moved to a second open position permitting such card withdrawal, said movement automatically activating an alarm, thereby preventing surreptitious removal of articles from the display.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
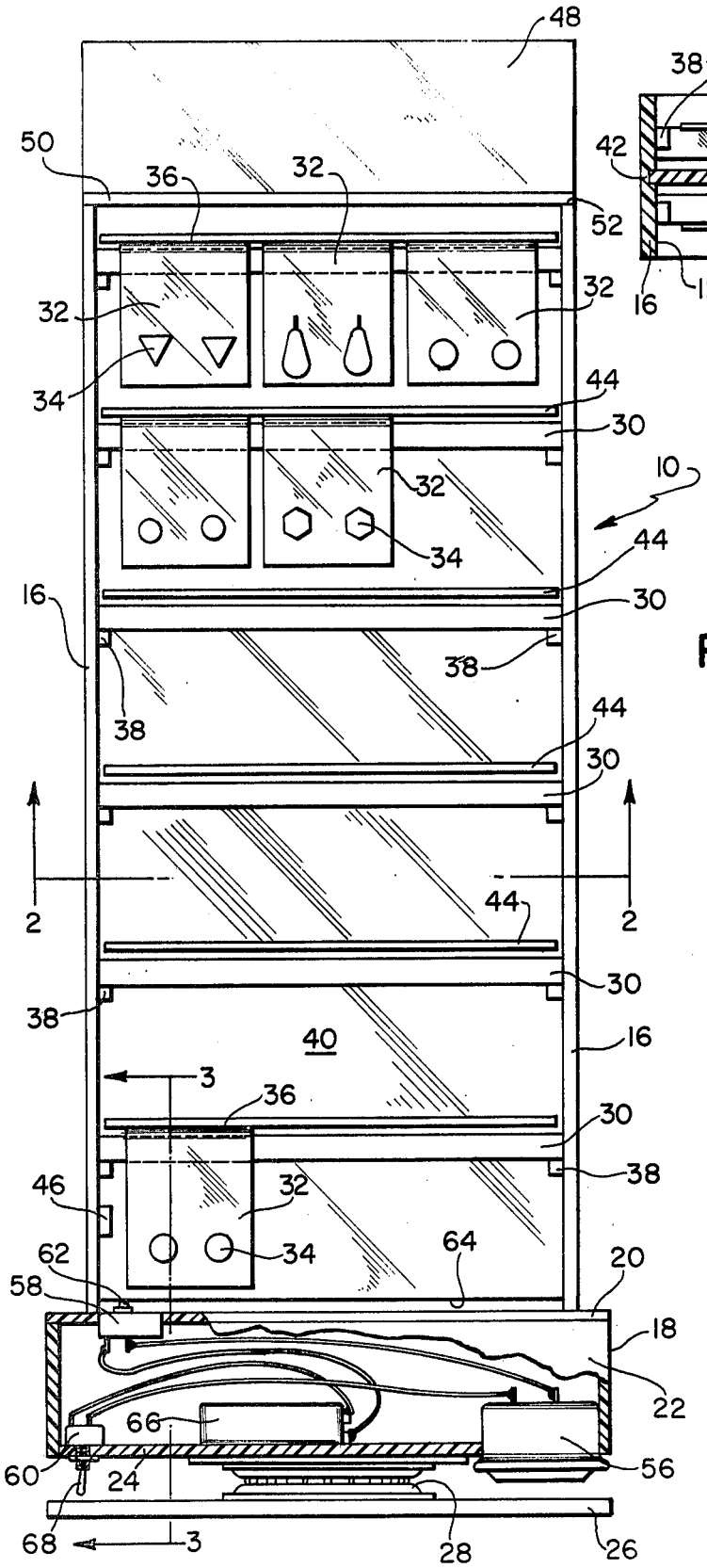
FIG. 1 is a front elevational view of a display case embodying the present invention.
Figure 2:
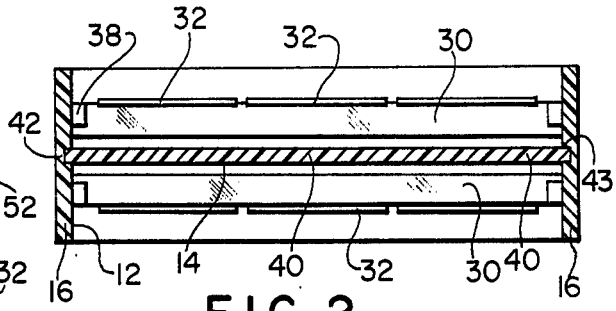
FIG. 2 is a plan sectional view taken along the line 2—2 of FIG. 1.

The display case 10 of the present invention includes a frame 12 and a slide 14. The frame in turn comprises a pair of upright members 16 disposed in generally parallel spaced relationship with each other. The members 16 may be attached to a substantially closed base 18 having a top wall 20, side walls 22 and a bottom wall 24. Furthermore, in order to conveniently rotate the device so as to enhance the display features thereof, and for other reasons which will hereinafter become more evident, the base 18 may be rotationally mounted upon a pad 26 by means of a conventional turntable structure 28. The pad 26 is in turn adapted for placement on any suitable support, such as a sales counter or the like.

Figure 3:
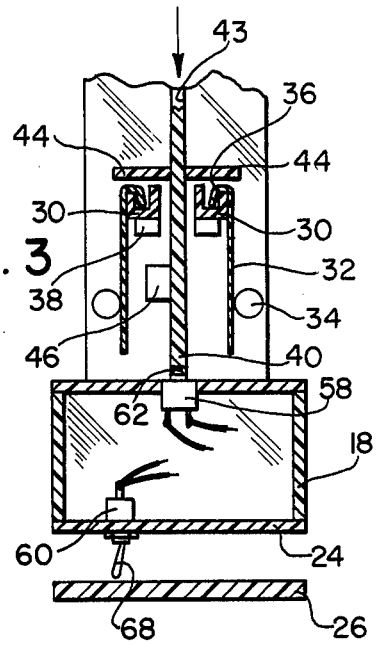
FIG. 3 is a partial side sectional view taken along the line 3—3 of FIG. 1.
Figure 4:
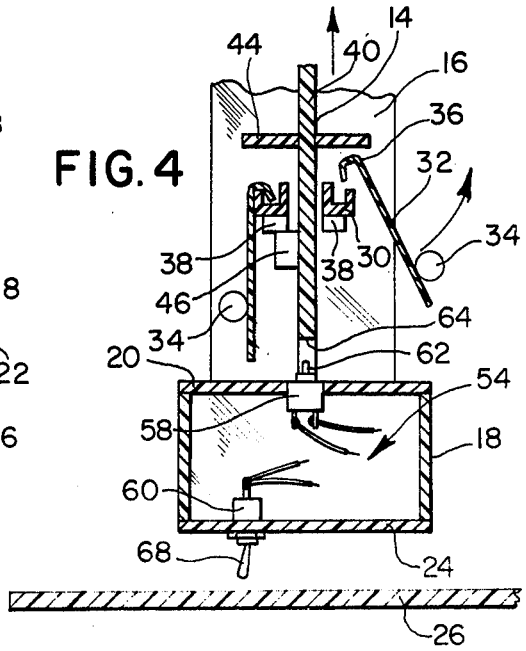
FIG. 4 is a side sectional view similar to FIG. 3 but showing the device in an open position wherein the article supports may be easily removed therefrom and wherein the device has also been pivoted 90 degrees from FIG. 3.

Pairs of horizontally, i.e. laterally, disposed rods 30 are adapted to span the distance between the upright members 16 for connection thereto at their opposite ends. The pairs of such rods 30 are not only spaced from each other from front to rear as best shown in FIGS. 3 and 4 but also are disposed in overlying relationship with each other as best shown in FIG. 1. Such rod pairs 30 may take any convenient form including the U-shaped channel configuration shown so long as such configuration lends itself to the support of cards 32 on which articles of jewelry, such as earrings 34, may be attached. The cards 32 further include a rearwardly extending flange 36, i.e. of downwardly open U-shaped configuration, such that the cards may be displayed in a generally vertical orientation with respect to the device 10. The rod pairs 30 may be secured in any suitable manner to the upright members 16 including direct adhesive connection thereto or by support on blocks 38 in turn directly connected to the upright members 16. Obviously if only one side of 46 device where to be utilized for display, then only one rod 30 would be utilized at each level rather than a pair thereof.

The slide 14 includes a generally planar member 40 terminating in side edges 42 in turn adapted for receipt in opposed grooves 43 formed in the inside surfaces of upright members 16. The slide 14 is thus vertically movable with respect to the frame 12. The slide further includes a plurality of horizontally disposed flanges 44 attached to the member 40 and spaced from each other along the vertical extent thereof. Such flanges 44 are adapted to overlie respective pairs of rods 30 in closely adjacent position thereto. Furthermore, by reason of the front to rear extension of the flanges 44 on opposite sides of the planar member 40, each pair of rods 30 has a flange 44 positioned thereabove. As best seen by reference to FIG. 3, wherein the normal closed position of the device is illustrated, the distance or space between the bottom of the flanges 44 and the top of the rods 30 is such that the flange 36 of the card 32 cannot be normally removed therefrom. Thus in this normal attitude of the device 10 the cards 32 are positioned in a reasonably secure attitude since a prospective purchaser cannot remove a card without further manipulation of the device.

However, inasmuch as the slide 14 is designed for vertical movement relative to the frame 12, it will be clear that its upward movement can increase the spacing between the flanges 44 and adjacent rods 30 to a point where the cards can be easily removed from the latter. Such position is shown in FIG. 4 of the drawing wherein the slide 14 has been moved upwardly to its open position. In order to limit such upward movement, stop means in the form of an extension 46 may be provided on one or both of the opposite faces of the member 40 so that such extensions 46 move upward therewith and contact one or more of the blocks 38 so as to limit the extent of upward slide movement. For convenience in manipulating, that is, upwardly moving the slide 14, the upper end of the member 40 is provided with an enlarged portion 48 in the form of a block which can easily be grasped by the user's hand. Such block 48 includes a lower surface 50 adapted to rest upon the upper edges 52 of the supports 16 when the slide is in its normal lower position. If desired, the block 48 may be provided with suitable advertising indicia or the like.

The base 18 includes alarm means 54 including an audio device 56, first switch 58, and a second switch 60. The first switch 58 includes a button 62 positioned so as to extend upwardly from the top wall 20 as through an opening therein and engage the lower edge 64 of the planar member 40 when the latter is in the closed or lower position shown in FIG. 3. This first switch 58 operates so that as long as the button 62 thereof is compressed, the alarm 56 is inactive but when the button 62 is allowed to move upward, as when the slide is moved from its closed to open position, such as shown in FIG. 4 of the drawing, the alarm is activated. Although the alarm shown is of an audio nature, other types of alarms, including visual ones, may be utilized. Thus it will be seen that the electrical circuit which energizes the alarm 56 is normally open, i.e. when the button 62 is depressed, but the circuit automatically closes when slide 14 is lifted so as to permit button 62 to move upwardly, it being understood that any suitable means (not shown) are provided for normally biasing the button 62 to its upper position.

The second switch 60 enables the entire alarm means 54 to be deactivated such that the alarm will not sound when the slide is lifted, as by authorized personnel, such as salespeople and the like. It is further contemplated that the alarm means 54 will be powered by a battery 66, however other power sources may be used. The switch 60 further includes a downwardly extending on/off member 68 which can in turn be manipulated by inserting one's finger beneath the bottom wall 24 of the base 18 between such base and the pad 26. In some cases it is further desirable to limit such space so one's fingers normally cannot be inserted therein to deactivate the alarm. In such cases it is necessary to rotate the device with respect to the pad 26 so that it is no longer in overlying relationship therewith, thus increasing the space available on the underside of the base 18 and thus enabling one's fingers to be inserted therebeneath to deactivate the switch 60. This is an added safety feature such as would be known to sales personnel but not immediately obvious to prospective customers. Thus, if a prospective customer or a would-be pilferer, not knowing of the existence of member 68, lifts the slide 14 to permit removal of one or more cards 32, the alarm 56 will automatically sound, thus warning sales personnel of such removal. On the other hand, if a prospective customer desires to closely inspect an article 34, he or she simply calls for a salesperson, who then discreetly operates the switch 60 to deactivate the electrical circuit, after which slide 14 may be lifted without any alarm being activated.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A display case comprising a frame having a plurality of laterally orientated article supports in generally parallel spaced overlying relationship to each other, a slide having laterally extending means overlying each of said article supports mounted on said frame for vertical movement with respect thereto between a first position wherein each of said laterally extending means of said slide are proximal that article support therebeneath to an extent whereby insufficient space exists between said supports and said means to permit removal of articles therefrom, and a second position wherein sufficient space exists therebetween so as to permit removal of said articles, and alarm means automatically activated by said slide movement from said first to said second position, said frame having a pair of opposed spaced upright members, said article supports being rods, said rods and said slide extending between said upright members, said slide laterally extending means being a plurality of generally parallel flanges spaced in overlying relation to each other, said rods defining said space through which said articles can or cannot be removed, dependent on the aforesaid position of said flanges, said alarm means supported by said frame and in turn having activation means adapted to be contacted by the bottom edge of said slide in said lower slide position, whereby upward movement of said slide out of contact with said activation means causes said alarm to be activated.

2. A display case comprising a frame having a plurality of laterally orientated article supports in generally parallel spaced overlying relationship to each other, a slide having laterally extending means overlying each of said article supports mounted on said frame for vertical movement with respect thereto between a first position wherein each of said laterally extending means of said slide are proximal to that article support therebeneath to an extent whereby insufficient space exists between said supports and said means to permit removal of articles therefrom, and a second position wherein sufficient space exists therebetween so as to permit removal of said articles, and alarm means automatically activated by said slide movement from said first to said second position, said frame having a pair of opposed upright members, said article supports being rods, said rods and said slide extending between said upright members, said slide laterally extending means being a plurality of generally parallel flanges spaced in overlying relation to each other, said rods defining said space through which said articles can or cannot be removed, dependent on the aforesaid position of said flanges, there being a pair of said rods disposed beneath each of said slide flanges, said rod pairs spaced from each other from front to rear, said slide being a generally planar member disposed between said rod pairs.

3. The display case of claim 2, a groove disposed in each of said upright members, said grooves opposed to each other and adapted to receive opposite side edges of said slide.

4. The display case of claim 1, said alarm means disposed in said base and having a switch for deactivating said alarm means.

5. A display case comprising a frame having a plurality of laterally orientated article supports in generally parallel spaced overlying relationship to each other, a slide having laterally extending means overlying each of said article supports mounted on said frame for vertical movement with respect thereto between a first position wherein each of said laterally extending means of said slide are proximal to that article support therebeneath to an extent whereby insufficient space exists between said supports and said means to permit removal of articles therefrom, and a second position wherein sufficient space exists therebetween so as to permit removal of said articles, and alarm means automatically activated by said slide movement from said first to said second position, said frame having a pair of opposed spaced upright members, said article supports being rods, said rods and said slide extending between said upright members, said slide laterally extending means being a plurality of generally parallel flanges spaced in overlying relation to each other, said rods defining said space through which said articles can or cannot be removed, dependent on the aforesaid position of said flanges, a generally enclosed base upon which said upright members are disposed, said base forming a bottom portion of said case, said slide having a manually graspable portion connected thereto at the top thereof for moving the slide up and down, said manually grasping portion adapted to overlie upper edges of said upright members and be supported thereby in said lower slide position, said base rotationally supported on a pad from which the bottom of said housing is closely spaced at a distance insufficient for insertion of one's finger therebetween, the combined thickness of said pad and its spacing between said base being sufficient for insertion of one's finger, said switch extending downwardly from a portion of the bottom of said base and accordingly reachable by one's finger when said base is rotated to misalign same with said pad.

6. The display case of claim 1, said slide movable by gravity from said open to said normally closed position.

7. A display case comprising a frame having a plurality of laterally orientated article supports in generally parallel spaced overlying relationship to each other, a slide having a plurality of laterally extending flanges disposed in overlying spaced relation to each other with each such flange respectively overlying one of said article supports, said slide mounted on said frame for vertical movement with respect thereto between a first position wherein each of said flanges are proximal to that article support positioned therebeneath such that insufficient space exists between respective supports and said flanges to permit removal of articles therefrom and a second position wherein sufficient space exists therebetween so as to permit removal of said articles, said frame having a pair of opposed spaced upright members, said article supports and said slide extending between said upright members, said article supports disposed in pairs thereof, said support pairs spaced from each other from front to rear, said slide being a generally planar member disposed between said support pairs, and alarm means automatically activated by said slide movement from said first to said second position, said alarm means supported by said frame and in turn having activation means adapted to be contacted by the bottom edge of said slide in said lower slide position, whereby upward movement of said slide out of contact with said activation means causes said alarm to be activated.

8. The display case of claim 7, a groove disposed in each of said upright members, said grooves opposed to each other and adapted to receive opposite side edges of said slide.

9. The display case of claim 7, said flanges being spaced from said article supports in said first position.

10. A display case comprising a frame having a plurality of laterally orientated article supports in generally parallel spaced overlying relationship to each other, a generally planar slide having a plurality of laterally extending flanges disposed in overlying spaced relation to each other with each such flange respectively overlying one of said article supports, said slide mounted on said frame for vertical movement with respect thereto between a first position wherein each of said flanges are proximal to that article support positioned therebeneath such that insufficient space exists between said supports and said flanges to permit removal of articles therefrom and a second position wherein sufficient space exists therebetween so as to permit removal of said articles, said frame having a pair of opposed spaced upright members, said article supports and said slide extending between said upright members, a groove disposed in each of said upright members, said grooves opposed to each other and adapted to receive opposite side edges of said slide, said slide having a manually graspable portion connected thereto at the top thereof for moving the slide up and down, said manually grasping portion adapted to overlie upper edges of said upright members and be supported thereby in said lower slide position.

11. The display case of claim 10, including alarm means automatically activated by said slide movement from said first to said second position, said alarm means supported by said frame and in turn having activation means adapted to be contacted by the bottom edge of said slide in said lower slide position, whereby upward movement of said slide out of contact with said activation means causes said alarm to be activated.

12. The display case of claim 11, said alarm means supported by said frame and in turn having activation means adapted to be contacted by the bottom edge of said slide in said lower slide position, whereby upward movement of said slide out of contact with said activation means causes said alarm to be activated.

* * * * *